United States Patent [19]

Smith

[11] 4,443,185

[45] Apr. 17, 1984

[54] HEATING OF WEBS

[76] Inventor: Thomas M. Smith, 1415 Golf Rd., Cinnaminson, N.J. 08077

[21] Appl. No.: 312,730

[22] Filed: Oct. 19, 1981

Related U.S. Application Data

[63] Continuation-in-part of Ser. No. 292,167, Aug. 11, 1981, and a continuation-in-part of Ser. No. 279,081, Jun. 30, 1981, and a continuation-in-part of Ser. No. 238,418, Feb. 26, 1981, and a continuation-in-part of Ser. No. 186,491, Sep. 12, 1980, Pat. No. 4,378,207, and a continuation-in-part of Ser. No. 178,121, Aug. 14, 1980, Pat. No. 4,373,904, and a continuation-in-part of Ser. No. 952,332, Oct. 18, 1978, Pat. No. 4,326,843, said Ser. No. 238,418, Ser. No. 186,491, and Ser. No. 178,121, each is a continuation-in-part of Ser. No. 94,901, Nov. 16, 1979, Pat. No. 4,272,238, and Ser. No. 20,079, Mar. 13, 1979, Pat. No. 4,290,746.

[51] Int. Cl.[3] ..... F27B 9/28

[52] U.S. Cl. ..... 432/59; 431/328; 432/72

[58] Field of Search ..... 432/8, 59, 72, 21, 140; 431/328; 266/103

[56] References Cited

U.S. PATENT DOCUMENTS

| | | | |
|---|---|---|---|
| 2,210,032 | 8/1940 | Hess | 101/416.1 |
| 2,268,986 | 1/1942 | Hess et al. | 432/72 |
| 2,804,693 | 9/1957 | Brodie | 34/18 |
| 3,359,965 | 12/1967 | Milligan | 431/328 |
| 3,421,746 | 1/1969 | McCoy | 432/59 X |
| 3,720,002 | 3/1973 | Martin | 34/18 |
| 3,905,764 | 9/1975 | Birke et al. | 8/140 |
| 3,909,196 | 9/1975 | Birke et al. | 8/140 |
| 3,973,328 | 8/1976 | Theobald | 34/4 |
| 3,984,198 | 10/1976 | Birke et al. | 432/8 |
| 4,080,158 | 3/1978 | Kondo et al. | 432/8 |
| 4,116,620 | 9/1978 | Stibbe | 432/59 |
| 4,146,974 | 4/1979 | Pray | 34/54 |
| 4,207,058 | 6/1980 | Petersohn et al. | 432/59 |
| 4,209,294 | 6/1980 | Vasilantone | 432/233 |
| 4,217,090 | 8/1980 | Whike et al. | 432/8 |
| 4,272,238 | 6/1981 | Smith | 431/328 |
| 4,290,746 | 9/1981 | Smith | 431/328 |
| 4,326,843 | 4/1982 | Smith | 431/328 |
| 4,354,827 | 10/1982 | Kissel | 432/21 |

FOREIGN PATENT DOCUMENTS

| | | |
|---|---|---|
| 55-118865 | 9/1980 | Japan . |
| 55-128461 | 10/1980 | Japan . |
| 55-156064 | 12/1980 | Japan . |
| 466658 | 6/1937 | United Kingdom . |
| 522654 | 6/1940 | United Kingdom . |

OTHER PUBLICATIONS

TAPPI, Jun. 1970, vol. 53, No. 6, pp. 1016–1025.
Products Finishing–May 1977, pp. 88–91.
Products Finishing–Feb. 1980, pp. 36–39.
Paper Entitled "The Heat Thru Drying System", 3 pages–apparently Published by Tech Mark, Newport, Rhode Island.
TAPPI Oct. 1960, vol. 43, No. 10–pp. 177A thru 185A (Horace L. Smith, Jr.).
German Paper entitled "Gasbeheizte Infrarotstrahler fur die Papier–und Kartontrocknung" by K. Kriege-r–pp. 704, 706, 708 and 710.
Article Entitled "New CD Moisture Profile Correction Hood Reduces Energy Consumption and Production Costs in High Speed Tissue Drying" by H. Holik, R. Pinter.
J. Krieger & Sohn KG paper entitled "Gas Heated Infra–Air–Drying Hoods for the Paper Industry" (8 pages).

*Primary Examiner*—John J. Camby
*Attorney, Agent, or Firm*—Connolly & Hutz

[57] ABSTRACT

Elongated webs of paper, textile, non-woven, and the like are heated by gas-fired burners, and where the webs are porous the hot combusted gas is sucked through the webs to add to the heating action. Where the webs contain an atmosphere-contaminating substance such as a coating having a vaporizable organic solvent, a shallow layer of the burner's gaseous combustion products can be swept over the coated web face as it is exposed to the burner's heating, to flush off the vaporized substance in relatively concentrated form in a fraction of the gaseous products. The flushed off concentrate contains little or no oxygen so that combustible vapors are not likely to form explosive mixtures. Separating the flushed off vapor from the concentrate is also easier.

14 Claims, 5 Drawing Figures

HEATING OF WEBS

The present application is a continuation-in-part of application Ser. Nos. 292,167, filed Aug. 11, 1981; 297,081, filed June 30, 1981; 238,418, filed Feb. 26, 1981; 186,491, filed Sept. 12, 1980 (U.S. Pat. No. 4,378,207 granted Mar. 29, 1983;) 178,121, filed Aug. 14, 1980, and (U.S. Pat. No. 4,373,904 granted Feb. 15, 1983;) 952,332, filed Oct. 18, 1978, now U.S. Pat. No. 4,326,843. Of these, Ser. Nos. 238,418, 186,491 and 178,121 are in turn continuations-in-part of application Ser. Nos. 94,901 filed Nov. 16, 1979 (U.S. Pat. No. 4,272,238 June 9, 1981); and 20,079, filed Mar. 13, 1979, now U.S. Pat. No. 4,290,746.

The present invention relates primarily to the heating of webs such as paper, textile and non-wovens, that are manufactured in long lengths and are heat treated during or after their manufacture.

Among the objects of the present invention is the provision of novel apparatus and methods for effecting such heat treatment.

Additional objects of the present invention include the provision of novel techniques for efficiently drying webs or removing from webs a solvent that should not be freely released to the atmosphere.

The foregoing as well as still further objects of the present invention will be more fully appreciated from the following description of several of its exemplifications, reference being made to the accompanying drawings wherein.

Figure 1:
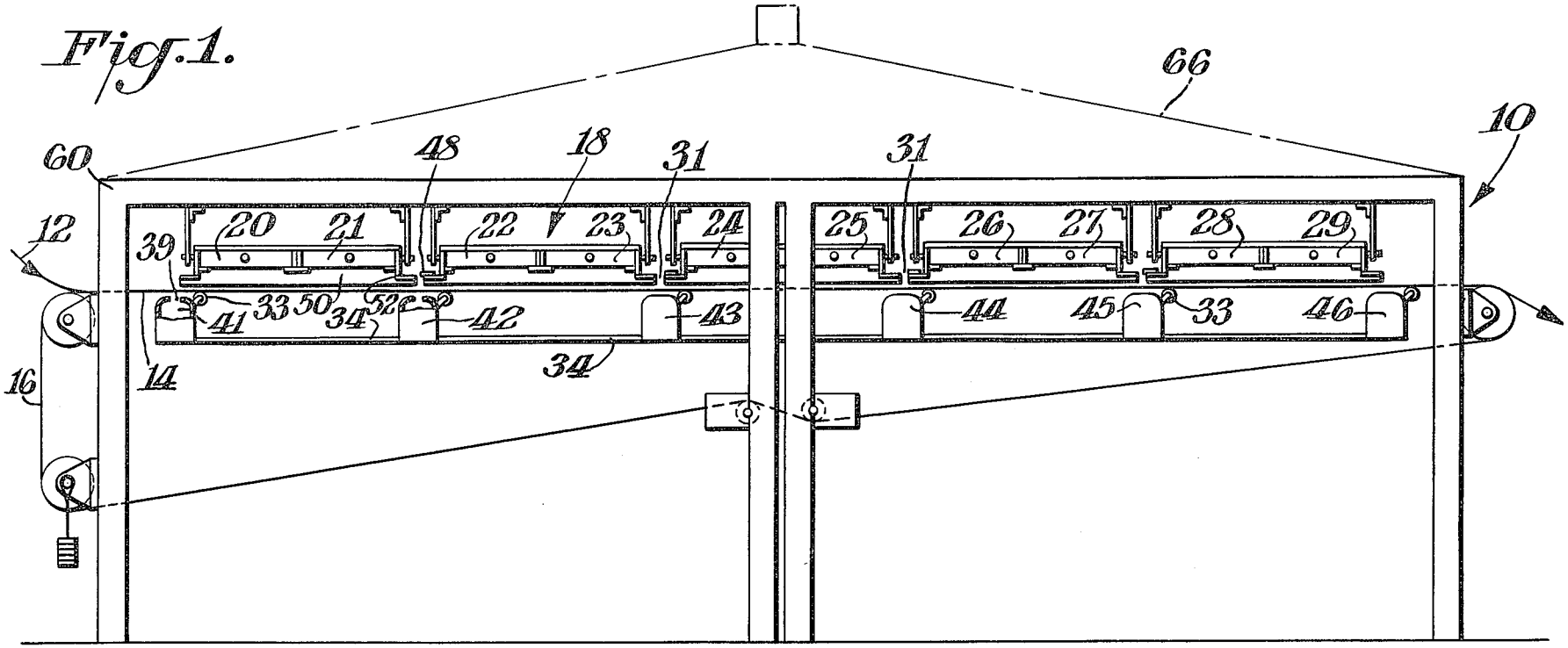
FIG. 1 is a somewhat schematic side view partly in section of a web-heating apparatus according to the present invention.

According to one aspect of the present invention, a heating apparatus is arranged to heat-treat an elongated porous web of material as it is carried in a continuous manner through a heat-treating station. This apparatus includes an endless porous conveyor belt threaded through that station and having an upper run to carry the web through the station, at least one gas-fired burner facing downwardly over said upper run, having the lower ends of its gas flames spaced not more than about five inches from the upper run, and extending approximately over the entire width of that run as well as over much of its length, and at least one suction box under the upper run and positioned to suck through the porous web and porous belt the hot combusted gases discharging from the burners.

The burner preferably has an infra-red surface heated by the flames, and a re-radiating panel is mounted under the upper run of the belt and facing the burners, to receive infra-red radiation and re-radiate it back upwardly through the porous conveyor run to the web.

According to another aspect of the present invention an apparatus has a heating chamber for heating an elongated web of material containing a substance that volatilizes when heated and thus contaminates the surrounding atmosphere. This heating chamber contains a gas-fired infra-red-energy-generating burner that faces but is spaced form the web as the web is carried through the chamber, directs the generated infra-red energy at a face of the web to heat it and also generates hot combustion gases, flow directing means is connected to direct at least some of those generated gases as a shallow stream in the space between the burner and the web and in contact with the heated face of the web to collect and sweep along the atmosphere-contaminating substance as it volatilizes from that face, and separating means is connected to receive the shallow stream after it has collected the volatilized substance, separate non-contaminating gases, and return at least some of those separated gases to the atmosphere.

The shallow stream preferably has a depth not more than about half the spacing between the burner and the web. That depth can be controlled at least in part by controlling the draw-off or escape of the hot gaseous combustion products so that they build up to a desired depth below the burner. The shallow stream depth can alternatively be controlled by a solid partition of infra-red transmissive material. It is preferred to have the shallow stream as thin as practical, but thicknesses of from about ½ inch to about 2 inches are effective. This relatively thin stream sweeps out essentially all the vapors generated by the volatilizable contaminant, and makes a relatively concentrated mixture from which it is simple and inexpensive to separate out the contaminating vapors as by cooling the stream to condense out the contaminant.

Also by permitting some of the hot gaseous combustion products to cool to temperatures of around 200° F. to 300° F. and using such partially cooled gases to collect the undesired vapors, subsequent cooling energy requirements to condense out the contaminant are further reduced, and the sweeping off of volatiles mixes those volatiles into an oxygen-starved gas stream in which it is difficult or impossible for the volatiles to form an explosive mixture.

Turning now to the drawings, FIG. 1 shows a heat-treating apparatus 10 for drying porous fabrics such as non-felted open webs of long-fibered thin sheets. Such a web 12 is delivered from a web-forming station for example, is received on the upper run 14 of an endless conveyor belt that carries the web through a heating station defined by a burner assembly 18. Assembly 18 is a collection of gas-fired burners 20, 21, 22, 23, 24, 25, 26, 27, 28 and 29, each extending across the width of the web 12 facing downwardly to heat the web as it is carried by the conveyor. The burners can be built along the lines shown in parent application Ser. Nos. 94,901 and 186,491 but are mounted in pairs, each pair being spaced from the next to provide gaps 31 that also extend the width of the web. A set of idler rolls 33 helps support the conveyor run 14, and as shown these rolls are preferably located where they do not receive the full blast of the infra-red energy generated by the burners.

Conveyor 16 is porous and is made of strands that withstand temeratures up to 400° F. or 450° F. A metal mesh conveyor belt can be used, but meshes of thermally resistant cords are particularly desirable since they do not carry off so much heat and the cords themselves are somewhat transmissive of infra-red energy. Also a fabric mesh conveyor is very light in weight and is much simpler to operate. Belt thickness as little as 1 millimeter are all that is needed. Aramid, qiana and other temperature—resistant fibers, tire cord grade Kevlar fibers for example, make good conveyor cords, and even nylon fibers can be used where they are not heated above about 250° F.

The conveyor face that receives web 12 is preferably coated with poly(tetrafluoroethylene) to minimize the danger of the web sticking to the upper run particularly when the web arrives in wet condition.

A series of suction boxes 41, 42, 43, 44, 45 and 46 is placed below the conveyor run 14, with their suction mouths 39 very close to or even contacting the lower face of the conveyor there. The mouths can be made of poly(tetrafluoroethylene) to minimize friction. The boxes are connected to a suction manifold 37 at one or both sides of the apparatus, and these manifolds are in turn connected to a suction blower. Between the suction boxes there are fitted infra-red re-radiators which can merely be sheets 34 of thermal insulation opaque to infra-red. The upper surface of these sheets have some of the burners' infra-red energy impinged on them through the porosities in the web and in the conveyor, and those surfaces are thus heated and themselves radiate infra-red energy. That re-radiated infra-red energy helps supply additional heat to the bottom of web 12.

The fibers of which web 12 is made may also be partly transparent to the infra-red generation, and thus permit more infra-red energy to reach the re-radiators.

The application of suction to the interiors of the suction boxes causes them to suck in gas through the porosities in the web and in the conveyor. Some of the very hot gaseous combustion products discharged by the burners are thus drawn through the web to further increase the heating effect. Also where the web is wet with water or contains any other volatilizable material, the movement of the sucked gases through the web greatly increases the removal of such material.

The gaps 31 between burner pairs permit the dilution of the hot combustion products with ambient air from between the burner pairs, so that mixtures of these two gases can be sucked through the web. Such mixtures can have temperatures much lower than the undiluted combustion gases, and some webs can be damaged by such undiluted gases. At the gaps the burners can carry adjusting devices such as slides 48 that can be shifted to cover or partially cover the gaps.

The degree of suction at the suction box mouths can be selected between about 1 and about 200 inches of water column, and the burner mouths sized to cause all or only some of the hot combustion gases to be sucked through the web, with or without dilution by ambient air. To help assure that all of those hot combustion gases are available to be sucked through the web, the burners can be fitted with end skirts 50 that extend downwardly more than the side walls 52. This causes the hot combustion gases to build up under the burner face until they spill out below the bottoms of the side walls.

The conveyor strands or cords preferably provide spaces of about 1 to about 4 millimeters between them, and such openings will not have any significant effect on the manner in which the web is supported by the conveyor. The side margins 56 of the conveyor can be made with less or no inter-strand spacing, and can be completely coated to strengthen it against tearing. An impervious edge boundary so provided also helps confine the boundaries of the suction effects and reduces suction losses.

The assembly of FIG. 1 can be mounted in a framework 60 only about 18 feet long, and does a drying job about as effective as 15 steam-heated drying rolls each 5 feet in diameter. Shorter burner assemblies can be used if less drying is desired.

The individual burners 20, 21, etc. can be of the air-seal type more fully described in the last-mentioned parent applications, or they can be of the non-air-seal type described in Ser. No. 952,332. Air-seal burners discharge significant amounts of air around the hot combustion gases, so that those gases are cooled somewhat by the discharged air before they flow out past side-walls 52. The air-seal flow can if desired be increased to the point that no additional ambient air is needed at gaps 31.

The burners of the parent applications are of the ceramic fiber type, that is they have a porous felted ceramic fiber mat through the thickness of which is passed the gas-air combustion mixture to be burned, and the mixture burns as it emerges from the mat. This burning heats to incandescence the fibers at the face from which the combustion mixture emerges, and these incandescent fibers generate the infra-red energy which is so effective. However other types of gas-fired infra-red burners can also be used, such as those that have ceramic plates heated to incandescence by gas flames, or those that have metal screening heated to incandescence. So-called catalytic burners are not desirable inasmuch as they are intended for operation at temperatures too low to do a good job of heating webs.

Assembly 10 may also be provided with a hood 66 that can be fitted with a blower to collect and remove combustion products and vapors. The web path in assembly 10 can be tilted rather than horizontal, so that the web moves in a direction inclined upwardly or downwardly, or even perfectly vertical.

Figure 3:
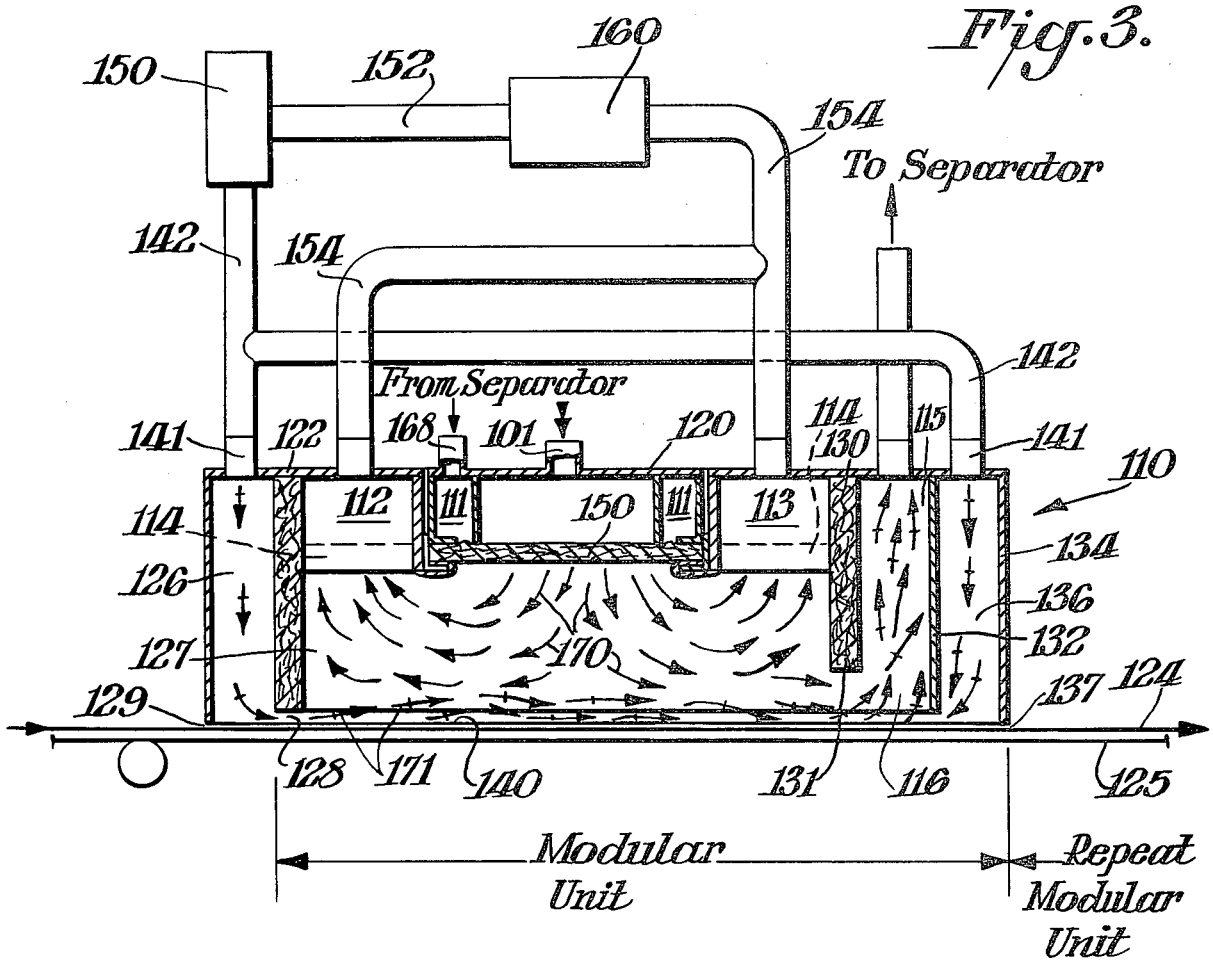
FIG. 3 is a view similar to FIG. 1, of a different heat-treating apparatus representative of the present invention.

FIG. 3 shows a burner assembly particularly suited for heat-treating moving webs carrying volatilizable material that contaminates the atmosphere if merely discharged into the air. Here a web 124 of freshly printed or coated paper as it moves from the printer or coater is passed under a heat-treater 110, and can be supported by a conveyor belt 125 or a series of idler rollers, or even a fixed supporting surface.

Assembly 110 contains a gas-fired burner 120 firing downwardly and having its incandescent face 150 spaced at least three, preferably four, inches from the paper web. On opposite sides of the burner are draw-off boxes 112, 113 having floors covered with porous re-radiators 114 as described in parent Ser. No. 292,167.

Upstream of draw-off box 112 is a thermally insulating partition 122 that descends to about one inch or less from the paper 124, to provide an entranceway 128 for a shallow stream 140 of flushing gas delivered through external conduit 126. The upstream lip 129 of conduit 126 is even closer to the paper 124, than partition 122.

Downstream of draw-off box 113 is another thermally insulating partition 130 extending downwardly toward the paper. The lower edge 131 of this partition is as far from, or a little farther from, the paper as the lower edge of partition 122. Downstream of partition 131 is a collection chamber 115 defined by wall 130 along with side walls 116, 117 and a far partition 132. An end wall 134 further downstream provides another external conduit 136, and like external conduit 126 the lower lip 137 of the external wall 134 of conduit 136 is located very close to the paper 124.

External conduits 126, 136 can be continued through side jackets 139, and can be interconnected that way to provide a peripheral enclosure through which gas is flowed downwardly to act as a curtain along both edges of the paper as well as upstream and downstream of the assembly 110. Upstream conduit 126 preferably has a depth in the upstream-downstream direction somewhat greater than that of the downstream conduit 136, so as to provide the extra gas that makes the shallow stream 140.

Both conduits 126, 136, as well as the peripheral jackets, are provided with intake connectors 141 and supply ducts 142, the latter being shown as joined together and forming the outlet for a blower 150. The intake 152 of the blower is fed from ducts 154 connected to draw-off boxes 112, 113. A heat exchanger 160 can be fitted in ducts 154 to cool the gases sucked from boxes 112, 113 into the blower.

The apparatus of FIG. 3 is operated by introducing a stream of gaseous combustion mixture into burner inlet 101, igniting the combustion mixture as it flows out from face 150, and passing the paper 124 to be treated under assembly 110. Ignition is conveniently effected by sparking using the electrode arrangement described in parent application Ser. No. 952,332.

Blower 150 is operated to suck the very hot combusted gases through draw-off boxes 112, 113 and after they are cooled to about 400° F. or below, to blow them through conduits 126, 136, and the side curtain jackets 139. This provides the shallow stream 140 that flushes across the surface of the paper and carries off vapors of organic printing or coating solvent or the like. Stream 140 with those vapors is in turn drawn off through chamber 115 and can then be led to a separator for separating out those vapors, as by cooling to condense them out as liquids.

The path of the gaseous combustion products as they leave the burner face 150 and move to the draw-off boxes is shown by the plain arrows 170. The path of the shallow stream is shown by the primed arrows 171.

Burner 120 is shown as a ceramic fiber matrix type burner, and can be fed a gas-air combustion mixture that is exactly or approximately stoichiometric. Its combustion products will then contain little or no oxygen, and the gas-containment effected by the gas curtains in the construction of FIG. 3 will sharply restrict or completely prevent the leakage of oxygen-containing air into those combustion products as they move through the above-described circuit. There is accordingly little or no risk of explosion even when the vapors swept from the paper are highly combustible in air. Wire screen burners also provide similar stoichiometric control of oxygen in their gaseous combustion products.

Stream 140 is preferably kept as shallow as practicable, inasmuch as this reduces the volume of gas mixture from which the vapors are to be separated. Some of the combustion gases leaving burner face 150 can be bled off to the atmosphere downstream of blower 150, in the event the gas curtain around the periphery of assembly 110 does not dissipate all the excess gas.

Burner 120 is desirably of the air-seal type having around its margin a sealing plenum 111 described in the parent applications. Although this plenum can be fed air at its intake 168 without adding too much oxygen to the burner's combustion products, it can also be fed with recirculating combustion products. Temperatures as high as 350° and even 400° F. can be tolerated for gases fed to the sealing plenum 111.

Alternatively the gas supplied to seal plenum inlet 168 can be some of the gas separated from the gas-vapor mixture. Thus where the vapor separation yields a recovery stream of vapor-contaminated gas with or without a separate stream of vapor-free gas, the contaminated gas can be fed to plenum 111. In the event the contaminating vapor is carbonized or converted to other undesired solids by the hot combustion gases, a little extra air can be added to the air-seal gases to help burn up such solids.

Heat exchanger 160 can be used to provide heat for other purposes. However the combustion mixture entering burner inlet 101 can be heated somewhat by heat exchanger 160 inasmuch as a limited amount of such heating, i.e. to bring the incoming combustion mixture to about 200° F., will not damage the burner and will actually increase its thermal efficiency. Where the vapor is combustible and not sufficiently valuable to be recovered, gas-vapor mixture can be supplied from chamber 115 to seal plenum intake 168, after only a little cooling. Such recycled vapor will be burned as it enters the combustion zone of burner 120, and where its combustion products are only oxides of carbon and hydrogen, does not create any problems. The content of vapor in such recycled mixture is generally too low to call for an adjustment of the air-to-gas proportion fed to burner 120, but such an adjustment can be made if desired.

The shallow flushing stream 140 is substantially cooler than the hot gaseous combustion products above it as it passes beneath the burner, and so tends to remain close to the paper even if it becomes further heated during such passage. Some movement of the hot combustion products into the narrow stream 140 can be tolerated, but it is preferred not to have any of the stream 140 work its way into a draw-off box 112 or 113. A temperature difference of at least about 400° F. between the stream 140 and the hot gaseous combustion products discharged by burner 120, is quite effective for this purpose.

Where more assurance is desired that stream 140 stay in place, or where that stream is to be made as shallow as ½ inch or shallower, a thin sheet of infra-red-transmitting material such as quartz can be fitted between partitions 122 and 130 to help contain that stream. In such an arrangement the temperature difference between stream 140 and the hot combustion products above it, can be less than 400° F. The shallow stream should however not be so hot as to damage the paper 124.

The face of the burner 120 becomes quite hot in use, and any metal members exposed to that heat are preferably covered with thermal insulation, as described in the parent applications, and the metal subdivided into sections that are spaced from each other to better allow for thermal expansion and contraction. Metal supports or retainers for thermally insulating partitions and the like can be similarly subdivided.

Figure 2:
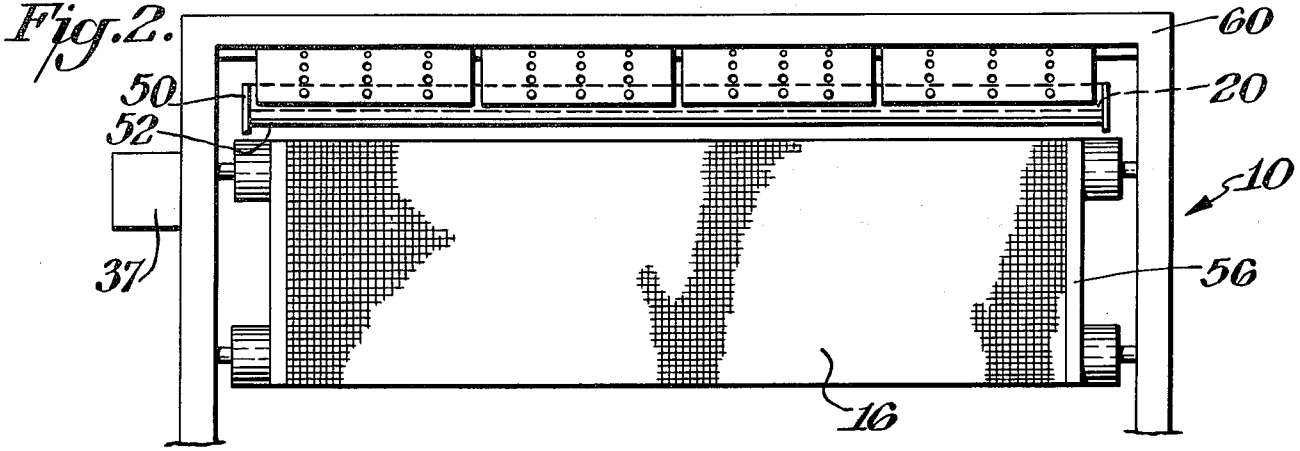
FIG. 2 is a front view, also partly schematic, of the apparatus of FIG. 1.
Figure 4:
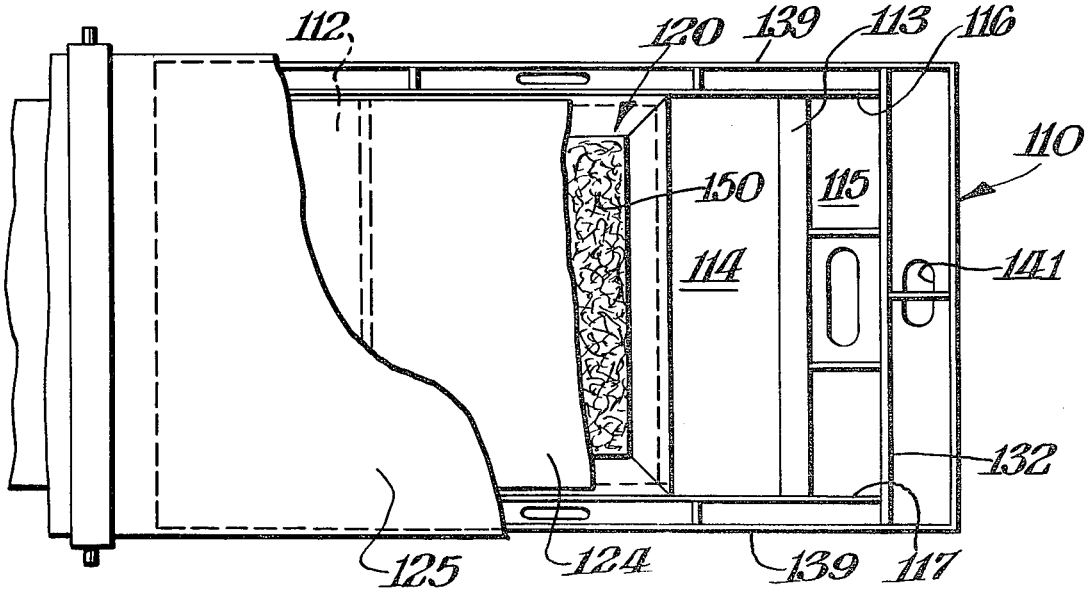
FIG. 4 is a plan view of a burner that can be used in the apparatus of FIG. 3, looking up at it from below.

A belt conveyor used with the construction of FIGS. 3 and 4 can be of the types described above in connection with FIGS. 1 and 2, but does not have to be porous.

Where the paper 124 or other material being heated is moving at a very rapid rate or contains very large quantities of volatiles, a second assembly 110 can be mounted at the downstream end of the first assembly to provide more heating and more vapor flushing. Conduit 136 of the second assembly can then be eliminated inasmuch as its sealing function is not needed. The shallow flushing streams of both assemblies can be kept separate, or can be combined as by also eliminating chamber 115 from the first section, or the conduit 126 of the second sections, or both.

In the event the paper 124 is to be printed or coated on both faces, a separate assembly 110 can be arranged to separately treat each face.

The web to be treated can also be moved in an inclined or vertical direction. Where there is an appreciable inclination of the web path, the lower draw-off box for combustion products can be omitted and the upper one made larger. For vertically-moving webs both faces of which need treatment, a separate burner assembly can be applied against each face, with the shallow vapor-flushing stream moving upwardly or downwardly. Preferably the flushing streams move counter-current to the web.

Webs can have their lower faces treated in the manner shown in FIGS. 3 and 4, as by using an inverted burner assembly having an inserted infra-red-transmissive gas barrier close to the lower face of the web. The shallow vapor-flushing stream will then be above the burner; and applying a small superatmospheric pressure to that stream will help keep the web being treated from sagging too much.

The webs printed or coated on one face, can have their opposite faces exposed to the infra-red irradiation, with a shallow stream of vapor-flushing gas directed along the printed or coated face. The web itself will then separate the vapor-flushing stream from the combustion gases produced by the infra-red generation. Where the webs are somewhat transparent to the infra-red energy, damage by overheating is easily controlled by limiting the radiation. Special cooling of the web is accordingly not needed unless the web is quite thick. The heat treatment can be immediately followed by cooling with very cold air or by engagement with a water-cooled roller, to shorten the time during which the web remains hot. Such cooling is best applied to the face that was irradiated.

Where it is desired to recover the vaporizable solvent in more or less anhydrous condition, the vapor-flushing gas should have a minimum of moisture content. Using unsaturated fuels such as pentadienes, butadiene, pentylenes, butylenes, propylene and/or ethylene, to fire the burners, yields combustion products having much less moisture content than that resulting from burning natural gas. The moisture content of those combustion products can be further reduced by passing those products through a moisture reducer such as steel wool which reacts with water vapor at elevated temperatures. Such reaction converts the reacted water vapor to hydrogen in amounts that can be over 10% by volume of the resulting combustion products.

Alternatively, the heat exchanger 160 can be used to cause the hot combustion products to heat oxygen-poor gas such as that recovered after freezing out the solvent vapors. This heated gas is then passed through duct 152 to form the shallow vapor-stripping stream. A gas stream so supplied would have its water vapor frozen out along with the solvent vapors.

Burners other than of the ceramic fiber matrix type can be used in place of burner 120, and a ceramic fiber burner without an air-seal such as described in patent application Ser. No. 952,332 can also be used. Alternatively cooling of the metal structure of the burners of FIG. 1 and FIG. 3 can also be arranged as by having water conduits brazed to that structure as described in Ser. No. 186,491.

Figure 5:
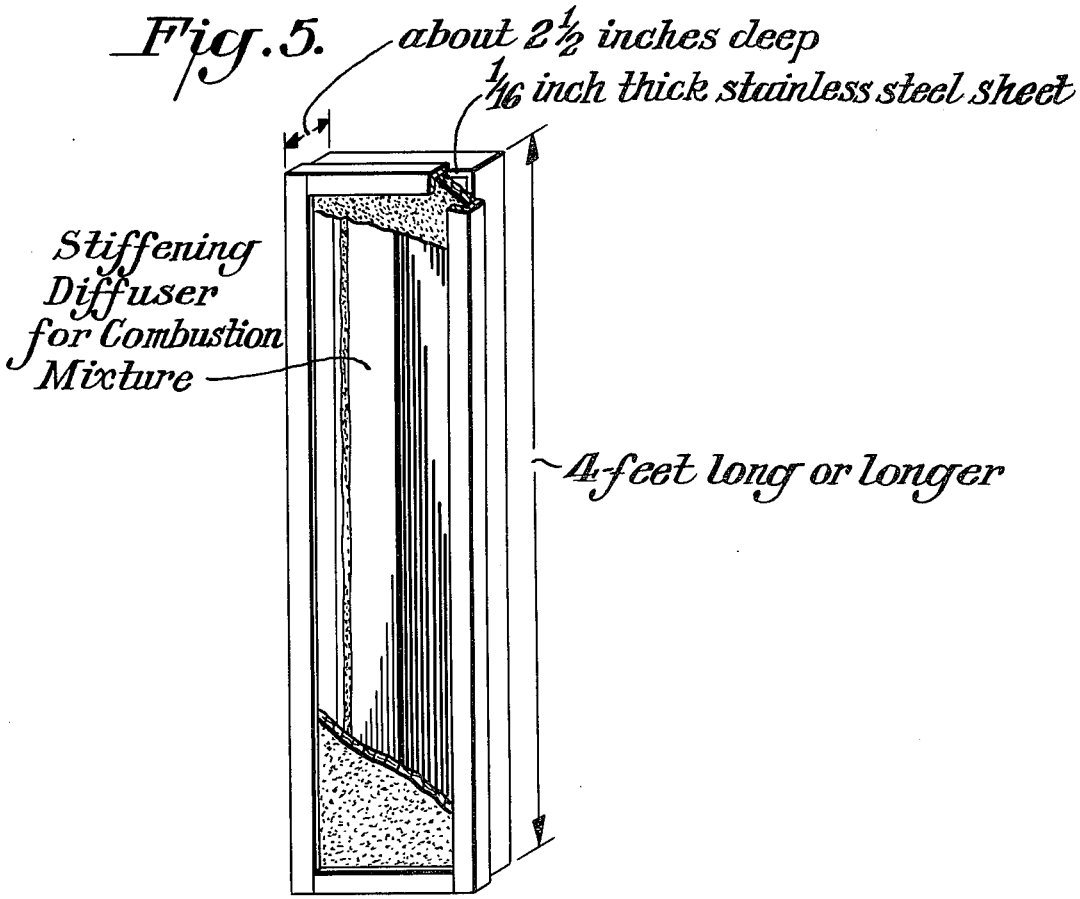
FIG. 5 is an isometric view of a burner that can be used in the apparatus of FIG. 1 and/or FIG. 3.

In general the burners are preferably of the type illustrated in FIG. 5, inasmuch as they are economical to manufacture and highly resistant to distortion by hot environments. That figure is copied from Ser. No. 178,121. These burners which are about 4 feet long or longer are best built with extra stiffeners welded onto the burner body and these stiffeners are preferably welded to the inner face of the combusting mixture plenum where they are kept cool by the flushing action of the combustion mixture. A seven-foot-long and one-foot-wide burner body about 2½ inches deep, will show little or no curling even though made of 1/16 inch thick stainless steel sheet, when there is welded to the inner face of its combustion mixture plenum a stiffening diffuser that extends the length of the body, as shown for example in U.S. Pat. No. 3,785,763. Welding a stiffener on the outside surface of the combustion mixture plenum will generally result in thermal curling apparently because the stiffener tends to heat up excessively in such a location. This problem is not so pronounced where the burner body is 5 or more inches deep or is made of ⅛ inch thick stock of plain carbon steel.

To minimize the thermal twisting of the matrix hold-down frame, which is a member that can get very hot, the matrix can be held in place by a succession of short lengths of angle metal. These can be for instance about 6 to about 24" inches long, and spaced slightly from the adjacent lengths so that each length is free to expand somewhat as a result of the heating they normally experience.

The individual lengths of hold-down angle can be bolted directly to the back wall of the burner, rather than to the shelf on which the matrix is mounted, to further increase the rigidity of the burner. Such bolts preferably go through an air-seal plenum, so that they do not have to be fitted to the burner by an air-tight engagement. A little extra air leakage around the bolts does no significant harm.

The gas fired infra-red generators can also be used to heat sheets or webs formed by dry felting fibers that are to be bonded together. Thus some of the fibers can be made of, or coated with, thermoplastic resin that on heating and pressing will bond to the remaining fibers and hold the web together. Such a web-forming technique can use fibers from many sources, including fibers reclaimed from paper-making broke or from used newsprint. Thermoplastic resins that can be used as bonding agents include polystyrene, polyethylene, and polypropylene. The resin fibers so used can be manufactured by extruding or spinning a lower-melting resin over an inner filament of a higher-melting resin or other material. Such two-layer fibers do a better job of bonding over a temperature range wider than that suitable for any one resin.

Obviously many modifications and variations of the present invention are possible in the light of the above teachings. It is therefore to be understood that within the scope of the appended claims the invention may be practiced otherwise than as specifically described.

What is claimed:

1. A heating apparatus for heat-treating an elongated porous web of material as it is carried in a continuous manner through a heat-treating station, said apparatus including an endless porous conveyor belt threaded through that station and having an upper run to carry the web through the station, at least one gas-fired burner facing downwardly over said upper run, having the lower ends of its gas flames spaced not more than about five inches from the upper run, and extending approximately over the entire width of that run as well as over much of its length to heat the porous web, and at least one suction box under the upper run and having a suction mouth positioned to suck through the porous web and porous belt the hot combusted gases discharging from the burners, the mouth being located essentially entirely beyond but adjacent the flames so that the hot sucked-in gases are diluted with ambient cooler gas.

2. The combination of claim 1 in which the burner has an infra-red radiating surface heated by the flames, and a re-radiating panel is mounted under the upper run of the belt and facing the burners, to receive infra-red radiation and re-radiate it back upwardly through the porous conveyor run to the web.

3. The combination of claim 1 in which the belt has a coating of poly(tetrafluoroethylene) on its web-engaging surface.

4. The combination of claim 3 in which the belt is a mesh of open-weave strands of material that withstands 400° F. temperatures.

5. The combination of claim 1 in which there are a group of burners some of which are spaced from each other in the direction the web is carried, and the suction box is positioned at least partially under that spacing to suck in at least some gas through that spacing.

6. In an apparatus having a heating chamber for heating an elongated web of material containing a substance that volatilizes when heated and thus contaminates the surrounding atmosphere, the improvement according to which the heating chamber contains a gas-fired infra-red-energy-generating burner that faces but is spaced from the web as the web is carried through the chamber, directs the generated infra-red energy at a face of the web to heat it and also generates hot combustion gases, flow directing means connected to receive some of those generated gases and direct them as a separate stream shallower than the space between the burner and the web and in contact with the heated face of the web to collect and sweep along the atmosphere-contaminating substance as it volatilizes from that face, and separating means connected to receive the shallow stream after it has collected the volatilized substance, separate non-contaminating gases, and return at least some of those separated gases to the atmosphere.

7. The combination of claim 6 in which the shallow stream has a depth not more than about half the spacing between the burner and the web.

8. The combination of claim 6 in which the apparatus provides a wall that holds the shallow stream close to the heated web surface.

9. The combination of claim 8 in which the burner faces downwardly, and the stream-holding wall is a wall of the hot combustion gases below the burner.

10. The combination of claim 9 in which the apparatus further includes draw-off means to draw off the hot combustion gases before they accumulate to a depth that brings them too close to the web.

11. The combination of claim 8 in which the stream-holding wall is a wall of a solid highly transparent to infra-red energy.

12. The combination of claim 6 in which the separating means includes cooling means connected to condense the contaminating substance from the shallow stream it receives.

13. The combination of claim 6 in which the apparatus also includes confining means to confine the sides of the shallow stream.

14. The combination of claim 13 in which the confining means includes gas-curtain means.

* * * * *